US006892540B1

(12) United States Patent
Tisenchek

(10) Patent No.: US 6,892,540 B1
(45) Date of Patent: May 17, 2005

(54) SYSTEM AND METHOD FOR CONTROLLING A STEAM TURBINE

(75) Inventor: Nicholas Tisenchek, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/709,769

(22) Filed: May 27, 2004

(51) Int. Cl.[7] ..... F01K 13/00
(52) U.S. Cl. ..... 60/645; 60/670
(58) Field of Search ..... 60/645, 670, 698

(56) References Cited

U.S. PATENT DOCUMENTS 6,260,350 B1 * 7/2001 Horii et al. ..... 60/39.3
6,705,086 B1 3/2004 Retzlaff et al. ..... 60/653
6,711,888 B2 3/2004 Horii et al. ..... 60/39.3

* cited by examiner

*Primary Examiner*—Hoang Nguyen
(74) *Attorney, Agent, or Firm*—Cantor Colburn LLP

(57) ABSTRACT

A system and a method for controlling a steam turbine in accordance with an exemplary embodiment are provided. The steam turbine has a first turbine subassembly and a second turbine subassembly both operably coupled to a rotor shaft for rotating the rotor shaft. The rotor shaft extends along an axis and being rotatably supported by a thrust bearing. The method includes determining a magnitude of an axial force being applied by the rotor shaft against the thrust bearing. The method further includes reducing an amount of steam being supplied to at least one of the first and second turbine assemblies when the magnitude of the axial force being applied against the thrust bearing exceeds a threshold value.

13 Claims, 3 Drawing Sheets

SYSTEM AND METHOD FOR CONTROLLING A STEAM TURBINE

BACKGROUND OF INVENTION

A steam turbine system includes a rotor shaft that is axially supported by a thrust bearing. During rotation of the rotor shaft, an axial force is exerted by the rotor shaft on the thrust bearing. When the axial force exceeds a predetermined force for an extended period of time, the thrust bearing can become degraded.

The steam turbine system detects when the thrust bearing becomes degraded by measuring an axial gap between the thrust bearing and a portion of the rotor shaft. When the axial gap between the thrust bearing and the portion of the rotor shaft is less than a predetermined distance, the system determines the thrust bearing is degraded. A disadvantage of this detection technique, is that no corrective action is taken to prevent degradation of the thrust bearing. Instead, the technique only detects degradation of the thrust bearing after it has occurred.

Accordingly, there is a need for a system that can prevent degradation of a thrust bearing, due to excessive axial force loading, before the degradation occurs.

SUMMARY OF INVENTION

A method for controlling a steam turbine in accordance with an exemplary embodiment is provided. The steam turbine has a first turbine subassembly and a second turbine subassembly both operably coupled to a rotor shaft for rotating the rotor shaft. The rotor shaft extends along an axis and being rotatably supported by a thrust bearing. The method includes determining a magnitude of an axial force being applied by the rotor shaft against the thrust bearing. The method further includes reducing an amount of steam being supplied to at least one of the first and second turbine assemblies when the magnitude of the axial force being applied against the thrust bearing exceeds a threshold value.

A system for controlling a steam turbine in accordance with another exemplary embodiment is provided. The steam turbine has a first turbine subassembly and a second turbine subassembly both operably coupled to a rotor shaft for rotating the rotor shaft. The rotor shaft extends along an axis and being rotatably supported by a thrust bearing. The system includes a first pressure sensor operably coupled to a first conduit supplying steam to the first turbine subassembly, the first pressure sensor generating a first pressure signal indicative of a pressure of the steam in the first conduit. The system further includes a second pressure sensor operably coupled to a second conduit supplying steam to the second turbine subassembly, the second pressure sensor generating a second pressure signal indicative of a pressure of the steam in the second conduit. The system further includes first and second valves operably disposed in the first and second conduits, respectively. The system further includes a computer operably coupled to the first and second pressure sensors and the first and second valves. The computer is configured to calculate a magnitude of an axial force being applied against the thrust bearing by the rotor shaft based on the first and second pressure signals. The computer is further configured to close at least one of the first and second valves when the magnitude of the axial force exceeds a predetermined threshold value.

An article of manufacture in accordance with another exemplary embodiment is provided. The article of manufacture includes a computer storage medium having a computer program encoded therein for controlling a steam turbine. The steam turbine has a first turbine subassembly and a second turbine subassembly both operably coupled to a rotor shaft for rotating the rotor shaft. The rotor shaft extends along an axis and is rotatably supported by a thrust bearing. The computer storage medium includes code for determining a magnitude of an axial force being applied against the thrust bearing by the rotor shaft. The computer storage medium further includes code for reducing an amount of steam being supplied to at least one of the first and second turbine subassemblies when the magnitude of the axial force exceeds a threshold value.

Other systems and/or methods according to the embodiments will become or are apparent to one with skill in the art upon review of the following drawings and detailed description. It is intended that all such additional systems and methods be within the scope of the present invention, and be protected by the accompanying claims.

DETAILED DESCRIPTION

Figure 1:
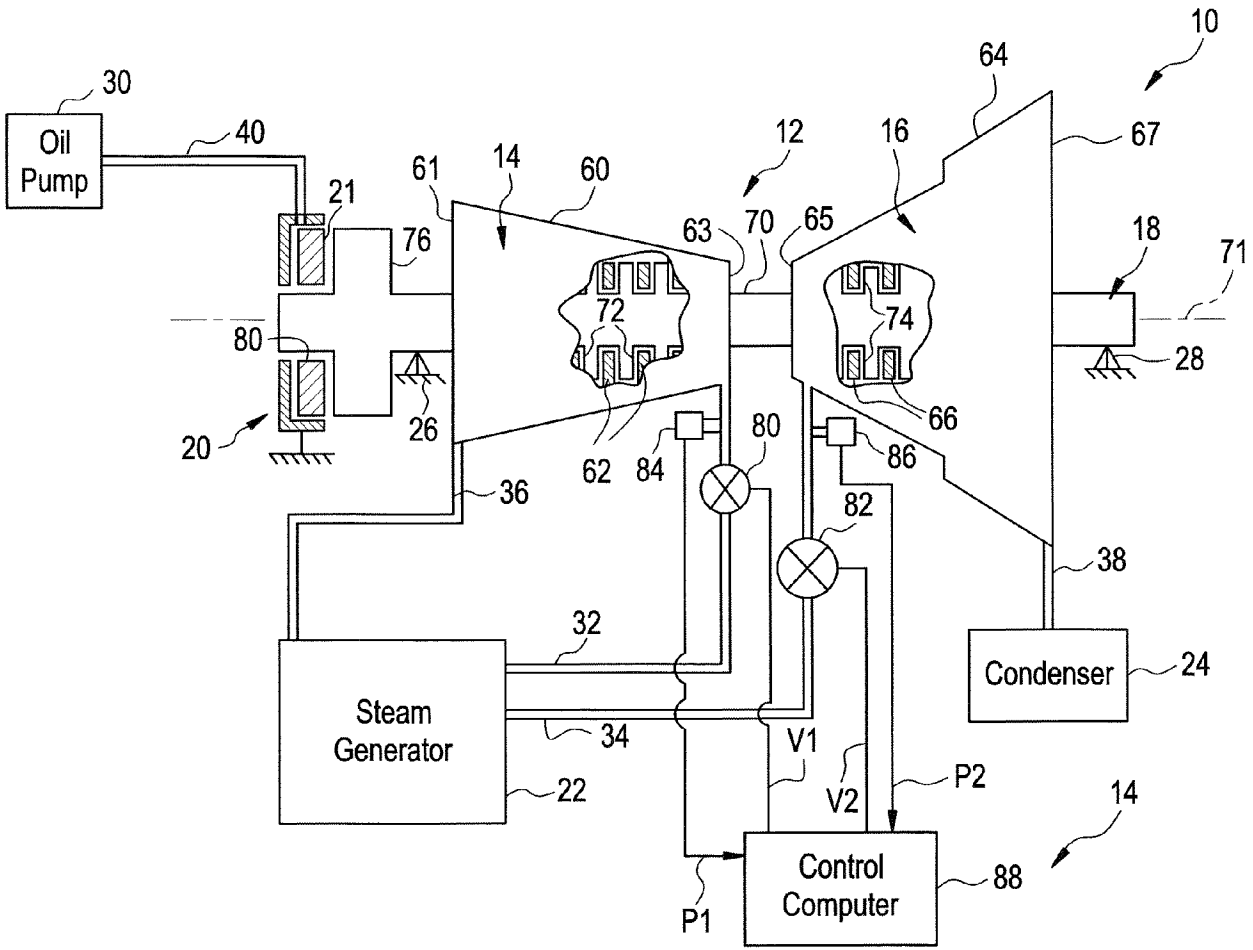
FIG. 1 is a schematic of a system for controlling a steam turbine in accordance with an exemplary embodiment.

Referring to FIG. 1, a steam turbine system 10 in accordance with an exemplary embodiment is provided. The steam turbine system 10 controls operation of the rotor shaft 18 such that an axial force applied to a thrust bearing 21 is controlled. The steam turbine system 10 includes a steam turbine 12 and a control system 14.

The steam turbine 12 is provided to rotate the rotor shaft 18. The steam turbine 12 includes a turbine subassembly 14, a turbine subassembly 16, the rotor shaft 18, a thrust bearing housing 20, a thrust bearing 21, a steam generator 22, a condenser 24, bearings 26, 28, an oil pump 30, and conduits 32, 34, 36, 38, and 40.

The turbine subassembly 14 is provided to induce a rotational force on the rotor shaft 18. The turbine subassembly 14 includes a housing 60 and a plurality of stationary impeller blades 62 contained within the housing 60. When steam enters an interior of the housing 60, the steam contacts a plurality of impeller blades 72 disposed about the rotor shaft 18 that induces the shaft 18 to rotate in a predetermined direction. The housing 60 includes an aperture (not shown) extending through an end wall 61 and an aperture (not shown) extending through an end wall 63 for receiving the rotor shaft 18 therethrough. Accordingly, a portion of the rotor shaft 18 extends through an interior of the housing 60.

The turbine subassembly 16 is provided to induce a rotational force on the rotor shaft 18. The turbine subassembly 16 includes a housing 64 and a plurality of stationary blades 66 contained within the housing 64. When steam enters an interior of the housing 64, the steam contacts the plurality of impeller blades 74 disposed about the rotor shaft 18 that induces the shaft 18 to rotate in a predetermined direction. The housing 64 includes an aperture (not shown) extending through an end wall 65 and an aperture (not shown) extending through an end wall 67 for receiving the rotor shaft 18 therethrough. Accordingly, a portion of the rotor shaft 18 extends through an interior of the housing 64.

The rotor shaft 18 includes a generally cylindrical rod portion 70 extending along an axis 71, a plurality of blades 72, a plurality of blades 74, and a flange portion 76. The plurality of blades 72 are disposed proximate a first end of the rod portion 70 so that the blades 72 are disposed within the housing 60. The plurality of blades 74 are disposed proximate a second end of the rod portion 70 so that the blades 74 are disposed within the housing 64. The flange portion 76 is disposed at the first end of the rod portion 70 that extends circumferentially about the rod portion 70 and has a larger diameter than the rod portion 70. When the rotor shaft 18 is rotated in a predetermined direction, a force is exerted on the rotor shaft 18 in an axial direction (e.g. left direction in FIG. 1). The flange portion 76 contacting the thrust bearing 21 transmits the axial force to the thrust bearing 21. As shown, the rotor shaft 18 is rotatably coupled to bearings 26 and 28 disposed proximate first and second ends, respectively, of the rotor shaft 18. The rotor shaft 18 is further rotatably coupled to the thrust bearing 21 that prevents the shaft 18 from moving in an axial direction.

The thrust bearing 21 is provided to allow the rotor shaft 18 to rotate within an aperture 80 disposed through the bearing 21 while preventing the rotor shaft 18 from moving in an axial direction (left direction in FIG. 1). The thrust bearing 21 is disposed at least partially within a housing 20. Further, the thrust bearing 21 comprises a copper pad having a thin film of oil disposed thereon. The thrust bearing 21 is disposed proximate the flange 76 of the rotor shaft 18. As shown, an oil pump 30 pumps oil through the conduit 40 into an interior of the housing 20 to lubricate the thrust bearing 21.

A steam generator 22 is provided to generate steam that produces a rotational force within the subassemblies 14 and 16 to induce the rotor shaft 18 to rotate in a predetermined direction about axis 71. The steam generator 22 outputs steam at a relatively high pressure that is transmitted through the conduit 32. Further, the steam generator 22 outputs steam at a relatively low pressure that is transmitted through the conduit 34. The steam generator 22 also receives steam exiting the turbine subassembly 14 through the conduit 36.

The condenser 24 is provided to condense steam exiting the turbine subassembly 16. In particular, the condenser 24 receives steam from the turbine subassembly 16 via the conduit 38 and condenses the steam.

The control system 14 is provided to control the turbine 12 such that an axial force transmitted from the rotor shaft 18 to the thrust bearing 21 does not exceed a threshold level for an extended period of time which could degrade the thrust bearing 21. The control system 14 includes valves 80, 82, pressure sensors 84, 86, and a control computer 88.

The valves 80, 82 are operably disposed within the conduits 32, 34, respectively. When valve 80 is in an open operational position, steam having a relatively high pressure is communicated from the steam generator 32 to an interior of the housing 60. Alternately, when valve 80 is in a closed operational position, steam from the steam generator 32 is prevented from entering the interior of the housing 60. When valve 82 is in an open operational position, steam having a relatively low pressure is communicated from the steam generator 32 to an interior of the housing 64. Alternately, when valve 82 is in a closed operational position, steam from the steam generator 32 is prevented from entering the interior of the housing 64. The operational position of the valves 80, 82 are controlled by signals (V1), (V2), respectively, generated by the control computer 88.

The pressure sensors 84, 86 are provided to generate pressure signals (P1), (P2), respectively, indicative of the steam pressures within the conduits 32, 34, respectively. The pressure signals (P1), (P2) are received by the control computer 88 which determines first and second pressure values based upon the signals (P1), (P2), respectively.

The control computer 88 is provided to control the operation of valves 80, 82 to control the rotational speed of the rotor shaft 18 and to further control the magnitude of the axial force applied to the thrust bearing 21. The control computer 88 is operably coupled to the valves 80, 82 and to the pressure sensors 84, 86. The control computer 88 is configured to generate signals (V1), (V2), to control an operational position of the valves 80, 82, respectively. The control computer 88 receives the pressure signals (P1), (P2) and is configured to calculate first and second steam pressures (PRESS1), (PRESS2) in conduits 32, 34, respectively, based upon the pressure signals (P1), (P2), respectively. Further, the control computer 88 is configured to calculate an axial force exerted by the rotor shaft 18 against the thrust bearing 21 based upon the steam pressures in conduits 32 and 34. In particular, the control computer 88 utilizes the following equation to calculate the axial force exerted by the rotor shaft 18 against the thrust bearing 21:

$$\text{Axial Force}=C1+C2*(PRESS1)+C3*(PRESS2)$$

wherein C1, C2, C3 are constants that are empirically determined.

Further, the control computer 88 is configured to close one or more of valves 80, 82 when the calculated Axial Force value is greater than a predetermined threshold value (PTHRESH). By closing one or more of the valves 80, 82, the Axial Force value can be reduced below the threshold value (PTHRESH) to prevent degradation of the thrust bearing 21.

Figure 4:
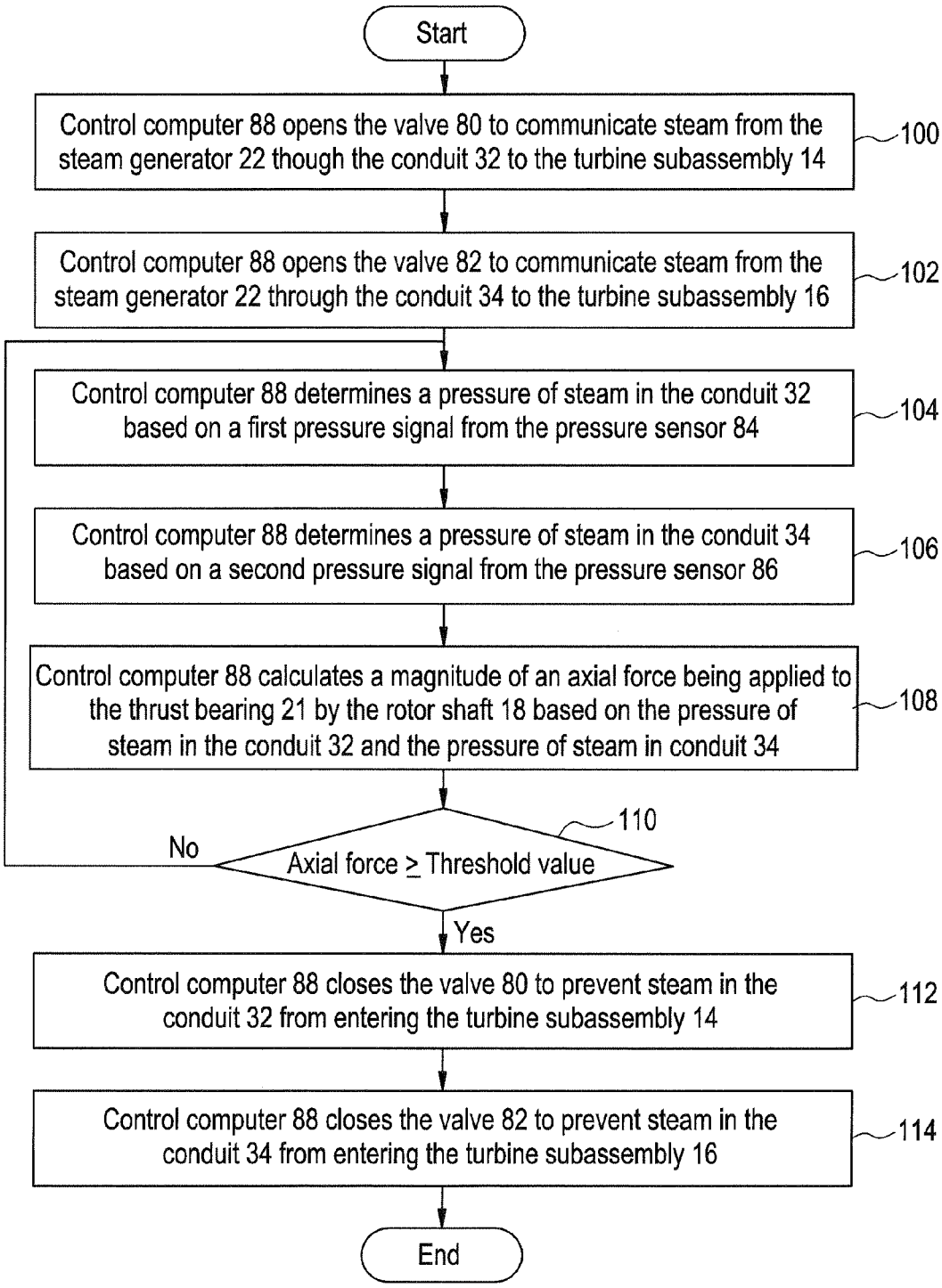
FIG. 4 is a method for controlling the steam turbine of FIG. 1.

Referring to FIG. 4, a method for controlling the system 10 in accordance with an exemplary embodiment will now be explained. An advantage of the following method is that the axial force exerted by the rotor shaft 18 on the thrust bearing 21 can be controlled such that degradation of the thrust bearing 21 is prevented.

At step 100, the control computer 88 opens the valve 80 to communicate steam from the steam generator 22 through the conduit 32 to the turbine subassembly 14.

At step 102, the control computer 88 opens the valve 82 to communicate steam from the steam generator 22 through the conduit 34 to the turbine subassembly 16.

At step 104, the control computer 88 measures a pressure of steam in the conduit 32 based on the pressure signal (P1) from the pressure sensor 84.

At step 106, the control computer 88 measures a pressure of steam in the conduit 34 based on the pressure signal (P2) from the pressure sensor 86.

At step 108, the control computer 88 calculates a magnitude of an axial force being applied to the thrust bearing 21 by the rotor shaft 18 based on the pressure of steam in the conduit 32 and the pressure of steam in the conduit 34.

At step 110, the control computer 88 makes a determination as to whether the magnitude of the axial force is greater than a threshold value. If the value of step 110 equals "yes", the method advances to step 112. Otherwise, the method returns to step 104.

At step 112, the control computer 88 closes the valve 80 to prevent steam in the conduit 32 from entering the turbine subassembly 14.

Finally, at step 114, the control computer 88 closes the valve 82 to prevent steam in the conduit 34 from entering the turbine subassembly 16.

The system and method for controlling a steam turbine represents a substantial advantage over other systems and methods. In particular, the system and method calculates an axial force exerted by the rotor shaft 18 against the thrust bearing 21. When the calculated axial force exceeds a threshold value, which could degrade the thrust bearing 21, the system and method reduces the amount of steam applied to the steam turbine subassemblies to reduce the axial force exerted by the shaft 18 against the thrust bearing 21. Thus, the system and method provides a technical effect of controlling an axial force exerted by the rotor shaft 18 against the thrust bearing 21 to prevent degradation of the thrust bearing 21.

As described above, the present invention can be embodied in the form of computer-implemented processes and apparatuses for practicing those processes. The present invention can also be embodied in the form of computer program code containing instructions embodied in tangible media, such as floppy diskettes, CD ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and/or executed by a computer, the computer becomes an apparatus for practicing the invention. When implemented on a general-purpose microprocessor, the computer program code segments configure the microprocessor to create specific logic circuits.

While the invention is described with reference to an exemplary embodiment, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiment disclosed for carrying out this invention, but that the invention includes all embodiments falling within the scope of the intended claims. Moreover, the use of the term's first, second, etc. does not denote any order of importance, but rather the term's first, second, etc. are used to distinguish one element from another.

I claim:

1. A method for controlling a steam turbine, the steam turbine having a first turbine subassembly and a second turbine subassembly both operably coupled to a rotor shaft for rotating the rotor shaft, the rotor shaft extending along an axis and being rotatably supported by a thrust bearing, the method comprising:

determining a magnitude of an axial force being applied by the rotor shaft against the thrust bearing; and reducing an amount of steam being supplied to at least one of the first and second turbine assemblies when the magnitude of the axial force being applied against the thrust bearing exceeds a threshold value.

2. The method of claim 1, wherein determining the magnitude of the axial force being applied against the thrust bearing comprises:

measuring a steam pressure being communicated to the first turbine subassembly to obtain a first pressure value;

measuring a steam pressure being communicated to the second turbine subassembly to obtain a second pressure value; and calculating the magnitude of the axial force based on the first and second pressure values.

3. The method of claim 1, wherein reducing the amount of steam being supplied to at least one of the first and second turbine assemblies comprises closing a first valve operably disposed within a first inlet conduit coupled to the first turbine subassembly to prevent steam from entering the first turbine subassembly.

4. The method of claim 3, wherein reducing the amount of steam being supplied to at least one of the first and second turbine assemblies comprises closing a second valve operably disposed within a second inlet conduit coupled to the second turbine subassembly to prevent steam from entering the second turbine subassembly.

5. A system for controlling a steam turbine, the steam turbine having a first turbine subassembly and a second turbine subassembly both operably coupled to a rotor shaft for rotating the rotor shaft, the rotor shaft extending along an axis and being rotatably supported by a thrust bearing, the system comprising:

a first pressure sensor operably coupled to a first conduit supplying steam to the first turbine subassembly, the first pressure sensor generating a first pressure signal indicative of a pressure of the steam in the first conduit;

a second pressure sensor operably coupled to a second conduit supplying steam to the second turbine subassembly, the second pressure sensor generating a second pressure signal indicative of a pressure of the steam in the second conduit;

first and second valves operably disposed in the first and second conduits, respectively; and a computer operably coupled to the first and second pressure sensors and the first and second valves, the computer configured to calculate a magnitude of an axial force being applied against the thrust bearing by the rotor shaft based on the first and second pressure signals, the computer further configured to close at least one of the first and second valves when the magnitude of the axial force exceeds a predetermined threshold value.

6. The system of claim 5, wherein the computer is further configured to determine first and second pressure values based on the first and second pressure signals, respectively, the computer is further configured to calculate the magnitude of the axial force based on the first and second pressure values.

7. The system of claim 5, further comprising a steam generator operably coupled to the first and second conduits.

8. The system of claim 5, further comprising a steam condenser operably coupled to the second turbine subassembly.

9. The system of claim 5, wherein the thrust bearing includes an aperture for receiving a rod portion of the rotor shaft, the rotor shaft having a flange portion disposed about the rod portion, the flange portion being proximate a surface of the thrust bearing.

10. An article of manufacture, comprising:

a computer storage medium having a computer program encoded therein for controlling a steam turbine, the steam turbine having a first turbine subassembly and a second turbine subassembly both operably coupled to a rotor shaft for rotating the rotor shaft, the rotor shaft extending along an axis and being rotatably supported by a thrust bearing, the computer storage medium comprising:

code for determining a magnitude of an axial force being applied against the thrust bearing by the rotor shaft; and code for reducing an amount of steam being supplied to at least one of the first and second turbine assemblies when the magnitude of the axial force exceeds a threshold value.

11. The article of manufacture of claim 10, wherein the code for determining the magnitude of the axial force being applied against the thrust bearing comprises:

code for determining a steam pressure being communicated to the first turbine subassembly based on a first pressure signal;

code for determining a steam pressure being communicated to the second turbine subassembly based on a second pressure signal; and code for calculating the magnitude of the axial force based on the steam pressure being received by the first turbine subassembly and the steam pressure being received by the second turbine subassembly.

12. The article of manufacture of claim 10, wherein the code for reducing an amount of steam being supplied to at least one of the first and second turbine assemblies, comprises code for closing a first valve operably disposed within a first inlet conduit coupled to the first turbine subassembly to prevent steam from entering the first turbine subassembly.

13. The article of manufacture of claim 12, wherein the code for reducing an amount of steam being supplied to at least one of the first and second turbine subassemblies, further comprises code for closing a second valve operably disposed within a second inlet conduit coupled to the second turbine subassembly to prevent steam from entering the second turbine subassembly.

* * * * *

UNITED STATES PATENT AND TRADEMARK OFFICE

CERTIFICATE OF CORRECTION

PATENT NO. : 6,892,540 B1
DATED : May 17, 2005
INVENTOR(S) : Nicholas Tisenchek

It is certified that error appears in the above-identified patent and that said Letters Patent is hereby corrected as shown below:

Title Page,
Item [57], ABSTRACT,
Line 6, after “and” delete “being” and insert therefor -- is --.

Drawings,
Fig. 1, between “21” and “20” delete “80” and insert therefor -- 21 --.
Fig. 4, in step 100, delete “though” and insert therefor -- through --.

Column 1,
Line 33, after “and” delete “being” and insert therefor -- is --.
Line 38, before “when” delete “assemblies” and insert therefor -- subassemblies --.
Line 45, after “and” delete “being” and insert therefor -- is --.

Column 2,
Line 32, after “DETAILED DESCRIPTION” insert therefor -- OF THE PREFERRED EMBODIMENTS --.

Column 3,
Lines 56, 58, 64 and 66, after “generator” delete “32” and insert therefor -- 22 --.
Line 66, after “82” delete “are” and insert therefor -- is --.

Figure 2:
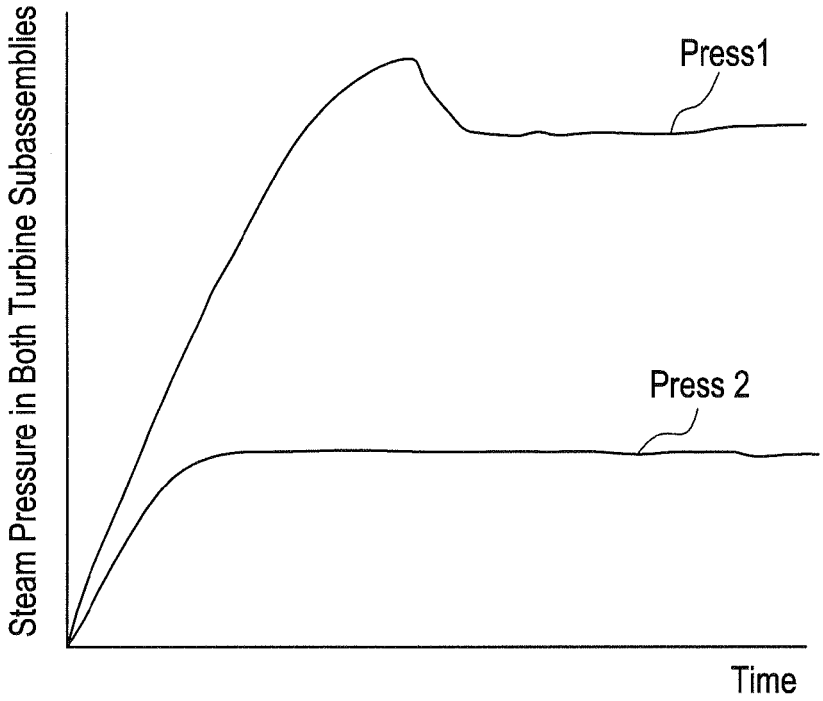
FIG. 2 depicts first and second steam pressures utilized in the system of FIG. 1.
Figure 3:
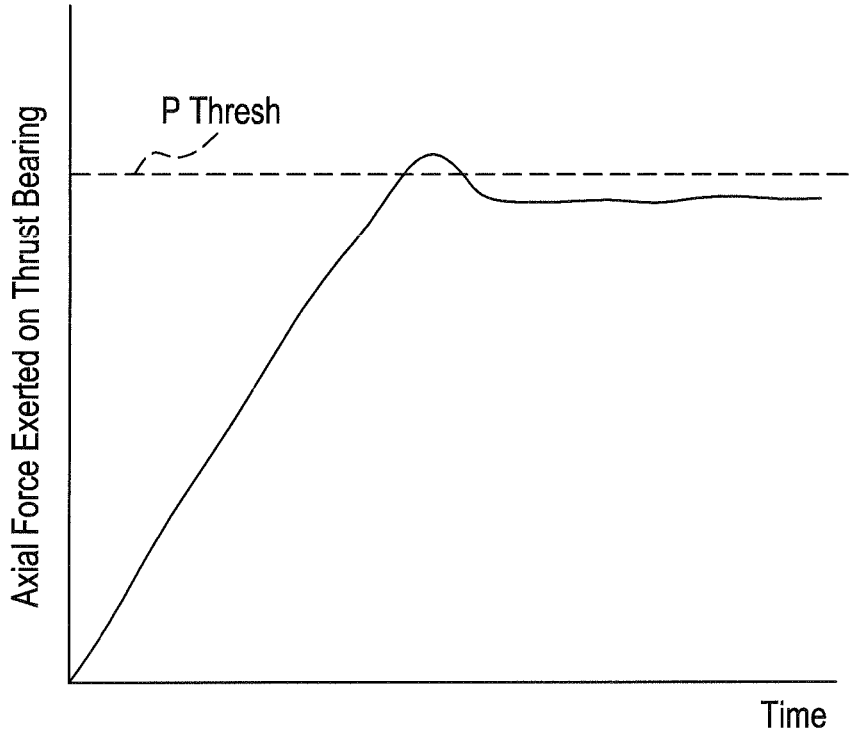
FIG. 3 depicts an axial force exerted on a thrust bearing of the system of FIG. 1.

Column 4,
Line 17, after “(PRESS2)” insert therefor -- (FIG.2) --.
Line 37, after “(PTHRESH)” insert therefor -- (FIG.3) --.

Column 5,
Line 49, after “the” (second occurrence) delete “term's” and insert therefor -- “terms” --.
Line 50, after “the” delete “term's” and insert therefor -- “terms” --.

Column 7,
Line 8, after “turbine” delete “assemblies” and insert therefor -- subassemblies --.

UNITED STATES PATENT AND TRADEMARK OFFICE

CERTIFICATE OF CORRECTION

PATENT NO. : 6,892,540 B1
DATED : May 17, 2005
INVENTOR(S) : Nicholas Tisenchek

It is certified that error appears in the above-identified patent and that said Letters Patent is hereby corrected as shown below:

Column 8,
Line 7, after "turbine" delete "assemblies" and insert therefor -- subassemblies --.

Signed and Sealed this

Thirteenth Day of September, 2005

JON W. DUDAS
*Director of the United States Patent and Trademark Office*